US012326079B2

(12) United States Patent
Chen et al.

(10) Patent No.: US 12,326,079 B2
(45) Date of Patent: Jun. 10, 2025

(54) INDUCTION LOOP CEMENTING PROGRESS DETECTION

(71) Applicant: Halliburton Energy Services, Inc., Houston, TX (US)

(72) Inventors: Songhua Chen, Katy, TX (US); Jinhua Cao, Humble, TX (US); Lonnie Carl Helms, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 647 days.

(21) Appl. No.: 17/224,843

(22) Filed: Apr. 7, 2021

(65) Prior Publication Data

US 2022/0325614 A1 Oct. 13, 2022

(51) Int. Cl.

| | |
|---|---|
| ***E21B 47/005*** | (2012.01) |
| ***E21B 17/14*** | (2006.01) |
| ***E21B 33/043*** | (2006.01) |
| ***E21B 33/13*** | (2006.01) |
| ***E21B 47/092*** | (2012.01) |
| ***E21B 47/12*** | (2012.01) |

(52) U.S. Cl.

CPC ..... *E21B 47/005* (2020.05); *E21B 17/14* (2013.01); *E21B 33/043* (2013.01); *E21B 33/13* (2013.01); *E21B 47/092* (2020.05); *E21B 47/138* (2020.05)

(58) Field of Classification Search

CPC .... E21B 47/005; E21B 47/902; E21B 47/138; E21B 17/14; E21B 33/043; E21B 33/13

See application file for complete search history.

(56) References Cited

U.S. PATENT DOCUMENTS

| | | | | |
|---|---|---|---|---|
| 5,323,856 | A | 6/1994 | Davis et al. | |
| 9,513,398 | B2 * | 12/2016 | Wilson | E21B 47/092 |
| 2003/0029611 | A1 | 2/2003 | Owens | |
| 2003/0192695 | A1 * | 10/2003 | Dillenbeck | E21B 33/05 166/285 |

(Continued)

OTHER PUBLICATIONS

Schlumberger Online Oilfield dictionary "shoe" printed Apr. 22, 2024 3 pages (Year: 2024).*

(Continued)

*Primary Examiner* — Alicia Bland

(74) *Attorney, Agent, or Firm* — DeLizio, Peacock, Lewin & Guerra LLP

(57) ABSTRACT

A wellbore fluid inductance monitor is disclosed, which operates at an end of a tubular in a wellbore. The wellbore fluid inductance monitor comprises an inductor in an electrical circuit. A magnetically doped portion of wellbore fluid, which may be a hydraulic fluid or cement slurry, is introduced into the wellbore during a reverse cementing or other cementing operation. The magnetically doped portion of wellbore fluid contains a dopant that alters at least one of a magnetic permeability and conductivity. The wellbore fluid inductance monitor detects the proximity magnetically doped portion of wellbore fluid based on altered electrical characteristics of the inductor. Based on the detection, the wellbore fluid inductance monitor triggers a wellbore operation which is detectable at a cementing controller and the cementing operation can be stopped or otherwise completed based on the determination that the cement slurry has reached the end of the tubular.

12 Claims, 8 Drawing Sheets

(56) References Cited

U.S. PATENT DOCUMENTS

| | | | | |
|---|---|---|---|---|
| 2016/0138367 | A1* | 5/2016 | Lirette | E21B 33/146 166/317 |
| 2016/0258280 | A1* | 9/2016 | Murphree | E21B 34/103 |
| 2017/0002622 | A1* | 1/2017 | De Bruijn | E21B 33/14 |
| 2017/0010378 | A1* | 1/2017 | Reiderman | G01V 3/14 |
| 2019/0048702 | A1* | 2/2019 | Vorhoff | E21B 7/06 |
| 2020/0088023 | A1 | 3/2020 | Gooneratne et al. | |
| 2021/0047913 | A1 | 2/2021 | Santamarina et al. | |
| 2021/0215037 | A1* | 7/2021 | Stewart | E21B 47/26 |
| 2022/0065818 | A1 | 3/2022 | Werkheiser et al. | |

OTHER PUBLICATIONS

PCT Application No. PCT/US2021/026280, International Search Report, mailed Jan. 3, 2022, 3 pages.
PCT Application No. PCT/US2021/026280, Written Opinion, mailed Jan. 3, 2022, 5 pages.

* cited by examiner

INDUCTION LOOP CEMENTING PROGRESS DETECTION

TECHNICAL FIELD

The disclosure generally relates to the field of earth or rock drilling, mining and to earth or rock drilling, obtaining oil, gas, water, soluble or meltable materials or a slurry of materials from wells.

BACKGROUND

At various stages during the drilling of wellbores, wellbore walls or tubulars are secured or protected by cementing stages where cementing is introduced and cured in one or more annular space around a tubular. Cementing processes involve monitoring the amount and location of cement delivered downhole in the wellbore, where monitoring is complicated by distance, and temperature, pressure, etc. of the downhole environment.

Conventional cementing involves introducing cement to the wellbore through a tubular (drill string, casing, production tubing, etc.), from where it is pushed out into the annulus via hydrostatic pressure. Reverse circulation cementing (hereinafter "reverse cementing") involves introducing cement directly to the annular space, where it travels to the cementing location assisted by gravity. Multi-stage or cross-over cementing can combine operations of conventional cementing and reverse cementing, such as through the use of a diverter, plug, etc. In conventional cementing, the progress of cement through an annulus can be tracked based on hydrostatic pressure—where pressure is required to pump the cement out of the casing and through the annulus. In reverse cementing, cement flows through the annulus where such flow is assisted by gravity in any vertical portions of the wellbore and may not be directly reflected in pressure readings.

BRIEF DESCRIPTION OF THE DRAWINGS

Embodiments of the disclosure may be better understood by referencing the accompanying drawings.

DESCRIPTION OF EMBODIMENTS

Figure 1:
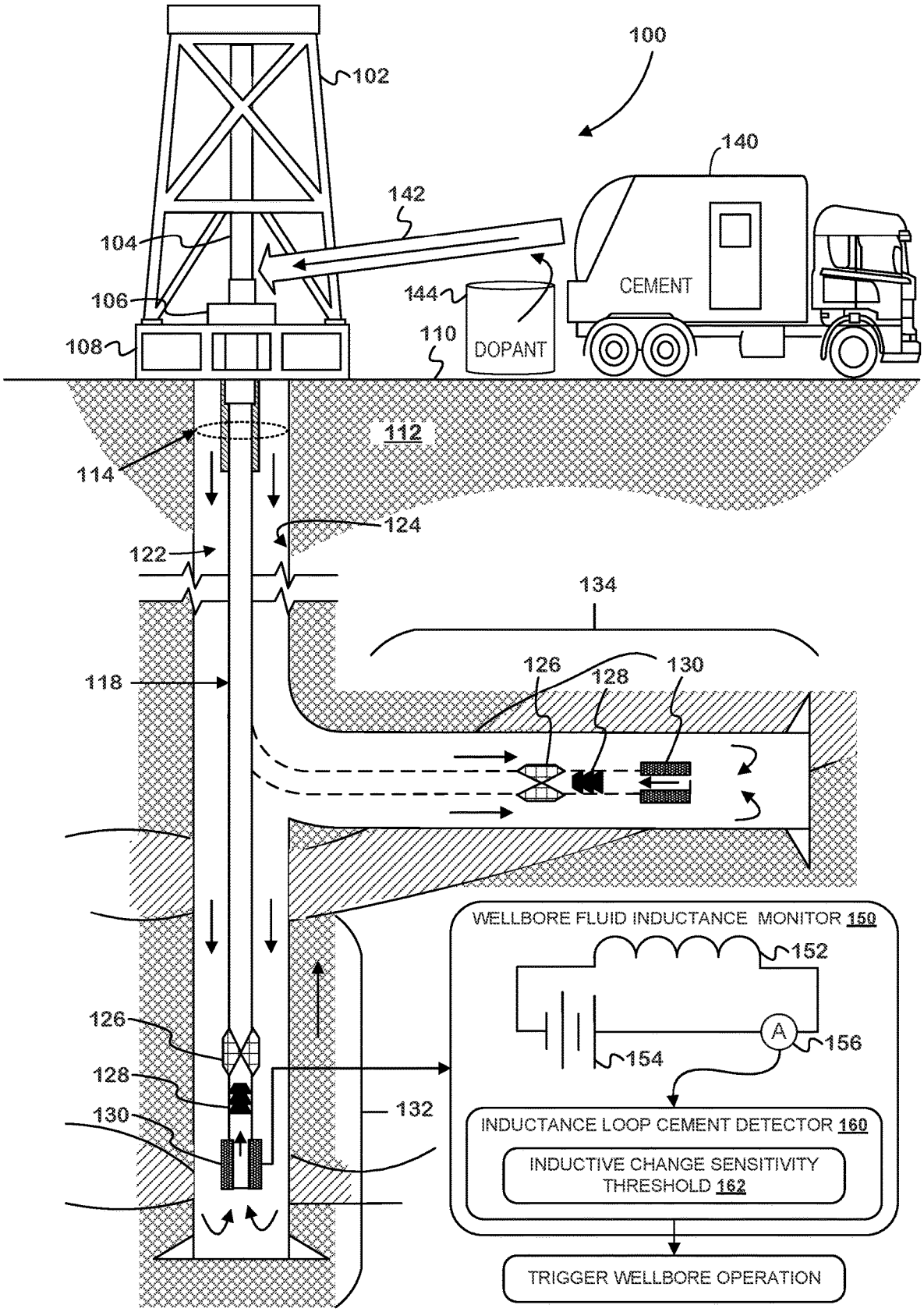
FIG. 1 illustrates an example system for detecting cement progress during wellbore cementing.

The description that follows includes example systems, methods, techniques, and program flows that embody embodiments of the disclosure. However, it is understood that this disclosure may be practiced without these specific details. For instance, this disclosure refers to reverse circulation cementing in illustrative examples. Embodiments of this disclosure can also be applied to conventional cementing or other types of cementing. In other instances, well-known instruction instances, protocols, structures and techniques have not been shown in detail in order not to obfuscate the description.

Overview

In order to prevent over cementing or otherwise monitor cementing, cement influx through a casing shoe (or otherwise into or through a tubular) is detected with an inductor. A circuit including an inductor is used to detect changes in magnetic field, which result from changes in magnetic permeability or conductivity of materials surrounding the inductor. For an inductor within the wellbore, material changes correspond to when a different slurry or fluid (e.g., mud slurry vs. cement slurry) passes through or near the inductor. Current flowing through a loop or other inductor produces a magnetic field in the surrounding volume, where the produced magnetic field is a function of the electrical characteristics of the surrounding volume including magnetic permeability of the medium or fluid. When the surrounding medium (e.g., slurry) moves in the magnetic field of the coil, the extant magnetic field induces electric currents (called eddy currents) in the slurry. The eddy currents induce their own magnetic field which generates an opposite current in the coil of the inductor. When the content of slurry or fluid changes, the strength of the eddy currents changes. The change in total electric current through the conductor of the inductor corresponds to a change in the material or properties of the material surrounding the coil. Changes in inductance are determined by measuring electrical characteristics of the circuit, such as changes in current, resonant frequency, etc. In instances where the wellbore fluid and cement or slurry have contrasting magnetic permeability or conductivity, a change in inductance is detected at the loop inductor when the cement reaches the inductor. In instances where the wellbore fluid and cement have similar magnetic or electrical properties, dopants, such as ferrites or other high conductivity or high magnetic permeability material, are added to the cement or slurry in order to generate sufficient contrast to wellbore fluid and produce a detectable change in inductance when the doped fluid reaches the inductor. Dopant profiles are used to create contrast greater than a sensitivity minimum, where the sensitivity minimum is a lower limit on detection that prevents false positive operation of the detector. The detection of a change in magnetic field triggers operation of a sleeve or other wellbore operation which ends the cementing stage or communicates the cementing stage completion to the surface.

Example Illustrations

FIG. 1 illustrates an example system for detecting cement progress during wellbore cementing. The system 100 includes a wellbore 114 configured for reverse cementing, in addition to other wellbore operations. The system 100 includes a drilling rig 102, or other support, a kelly 104, and a rotary table 106 on a drilling platform 108. The kelly 104 and the rotary table 106 can be replaced with other apparatus, such as a top drive, hammer drive, or tubular feeding apparatus (i.e., elevators, casing float equipment, etc.) as appropriate for various cementing and wellbore operations. The drilling platform 108 is shown as located at the surface 110 of a geological or subsurface formation 112, but can also be located underwater, i.e., subsea, on the ocean floor or at or above the waterline and connected to a subsea wellbore. A tubular 118 is lowered into the wellbore 114 from the drilling rig 102. The tubular 118 is connected to or contains one or more sleeve 126, one or more cementing plug 128, and ends in one or more smart shoe 130. The sleeve 126 can be a collar or other tubular section, including one or more valves. The tubular 118 can be coiled tubing, drill string, production tubing, casing, liner, etc. and can include various threaded and unthreaded connections, sleeves, and internal and external operators including centralizers, stabilizers, packers, turbolizers, scratchers or brushers, hangers, guide shoes, etc. The wellbore 114 is depicted as containing a substantially vertical portion 132 and a substantially horizontal or lateral portion 134. The wellbore 114 can instead contain sequential vertical and lateral portions or several lateral portions branching off of one or more vertical trunks.

Fluids in the wellbore can include drilling fluid, drilling mud, wellbore fluid, formation fluid, cement, slurry, hydraulic fluid, displacement mud, etc. Fluid can enter the wellbore 114 from the surface 110 through the tubular 118 or the annulus 122, or from the formation through the wall 124 of the wellbore 114. In uncased wellbores, including during drilling, hydraulic pressure maintained within the pore pressure fracture gradient window protects the formation from damage and the wellbore from influx of formation fluids and gasses. In reverse cementing, cement or slurry is introduced from a cement or slurry source 140 into the annulus 122 via a slurry delivery system 142. The slurry contains cement and liquid and dry additives and is the liquid or semi-liquid fluid pumped into the wellbore 114 which hardens or cures into cement. The slurry delivery system 142 includes a slurry dopant source 144, which can be used to dope a portion of the slurry produced by the cement or slurry source 140 (hereinafter slurry source 140). The slurry delivery system 142 can be a pressurized delivery system connected to or fluidically in communication with the wellbore 114 or to a fluid inlet of the wellbore 114. The slurry source 140 can be or include a cement truck, a cement plant, or any appropriate cement or slurry source. The slurry source 140 can include a dopant delivery system as well as the slurry dopant source 144, or the slurry delivery system 142 can include a dopant delivery system as well as the dopant source 144. The slurry dopant can be a fluid, solid, particulates, suspension, colloid, etc. and can be delivered in powdered form to wet or dry cement or slurry. The slurry dopant is selected for at least one of its magnetic or electrical properties. The slurry dopant is selected from a set of cement or concrete additives that are supportable in the slurry and do not degrade current cement performance. The slurry dopant is density matched to the concrete or slurry density such that gravitational segregation is substantially negligible. The cement or slurry dopant concentration can be controlled, such that the dopant profile is steady over one or more stages or so that the dopant concentration varies as a function of time or depth.

Additionally, the cement or slurry delivery can be preceded by delivery of a density or viscosity-controlled fluid quantity, such as a bolus, slug, pill, etc., to the wellbore 114, where such a fluid bolus can prevent cement acceleration due to gravity, gravitational segregation, and reduce cement or slurry mixing with wellbore fluid. The bolus can be delivered by the slurry delivery system 142 or any other appropriate fluid delivery system. The bolus can be water or hydrocarbon based. The bolus can be doped with the same or a different dopant used to dope the cement or slurry in order to increase inductance contrast between fluids and fluid layers.

The cement or slurry travels down the annulus 122 between the wall 124 of the borehole and the tubular 118. The cement or slurry can be propelled through the annulus 122 via gravity and assisted by pumping of the wellbore fluid or the displacement mud. For example, by pumping fluid through the tubular 118 to an exit at the surface, a closed loop system is created which advances the cement or slurry through the annulus 122. The cement or slurry flow is detected at the smart shoe 130, where the smart shoe 130 operates a circuit including an inductor which detects a change in magnetic field value caused by the change in magnetic permeability between the wellbore fluid and slurry or between the wellbore fluid and a doped fluid.

The smart shoe 130 contains a wellbore fluid inductance monitor 150. The wellbore fluid inductance monitor 150 contains an inductor 152, a voltage source 154, and an ammeter 156. Embodiments may use a current source instead of a voltage source. The voltage source 154 can be DC (such as a battery). Embodiments may use a magnetometer instead of or in addition to the ammeter 156 or any other appropriate method for measuring current. The inductor 152 can be a loop, a solenoid, a toroid, or any other acceptable inductor geometry. The inductor 152 can be applied to a surface of the smart shoe 130 or integrated into the smart shoe 130. The inductor 152 generates a magnetic field as a function of electric current traveling along the current path of the inductor, where the magnetic field exists at least partially in the fluid within or surrounding the tubular 118. The wellbore fluid inductance monitor 150 monitors the inductance of the fluid proximate to the tubular 118 based on the output of the ammeter 156 or another electrical measurement.

The wellbore fluid inductance monitor 150 contains or communicates with an inductance loop cement detector 160. Based on the output of the ammeter 156 or another electrical measurement, the inductance loop cement detector 160 detects changes in inductance. When the inductance loop cement detector 160 detects a change in current or magnetic field due larger than an inductive change sensitivity threshold 162, the inductance loop cement detector determines 160 that the wellbore fluid has changed—from a wellbore fluid such as displacement mud to an undoped slurry or magnetically doped fluid or slurry—and triggers a wellbore operation. The inductance loop cement detector 160 triggers or transmits instructions to trigger a valve closure or other actuation, such as delivery of the cementing plug 128—to block the sleeve 126. The cementing plug 128 closes the sleeve 126, which prevents the slurry from traveling up the tubular 118 (or through the tubular to the surface in a horizontal or angled well) and is detectable as a pressure increase. The triggered operation can instead by any other wellbore operation which results in a detectable change (e.g., pressure or flow rate) at a cementing controller. Instead of a pressure increase, the triggering of a wellbore operation can be detectable as an acoustic pulse or mud pulse, a decreased flow rate, or any communication from the end of the tubular 118 to the surface 110 or a controller or monitor.

The inductance loop cement detector 160 triggers the wellbore operation when the detected change in inductance meets a trigger criterion based on the inductive change sensitivity threshold 162, such as that shown in Equation 1, below.

$$S_L = 100 \times \left| \frac{L_0 - L_S}{L_0} \right| >> X \quad (1)$$

where $S_L$ is the induction loop sensitivity, $L_0$ is the inductance measured when un-doped cement or slurry or wellbore fluid passes by the inductive element (i.e., baseline), $L_S$ is the inductance measured when doped cement or slurry passes by the inductive element (i.e., triggering event), and X is the detection threshold or trigger criterion. X can be the inductive change sensitivity threshold 162 or based on the inductive change sensitivity threshold 162. The value of X can depend on the system, including on the inductance values of the cement or slurry, formation fluid, and doped cement or slurry, and on the noisiness or variability of inductance measurements. For example, in stable systems X can be as low as three (3), while in noisier systems including those that are thermally or fluidically unstable X=5 can be instead used as trigger criterion.

The inductance loop cement detector 160 can directly calculate values of inductance or can operate on values of one or more other electrical or magnetic characteristics as a proxy for values of inductance—such as output of the ammeter 156. In some embodiments, the inductance loop cement detector 160 operates on the output of the wellbore fluid inductance monitor without directly calculating a value of inductance. For example, the inductance loop cement detector 160 can operate on an AC resistor-inductor-capacitor (RLC) circuit, which operates at a characteristic resonance frequency such as that given by Equation 2, below:

$$\omega_0 = \frac{1}{\sqrt{LC}} \quad (2)$$

where $\omega_0$ is the resonance frequency, L is the inductance of the inductor, and C is the capacitance of the capacitor. A change in the inductance L of such a circuit causes a corresponding change in the resonance frequency $\omega_0$, which can be measured at the ammeter 156 or otherwise monitored or detected. Electrical circuit organization and output and inductance measurement will be discussed in more detail with respect to FIG. 6.

Figure 2A:
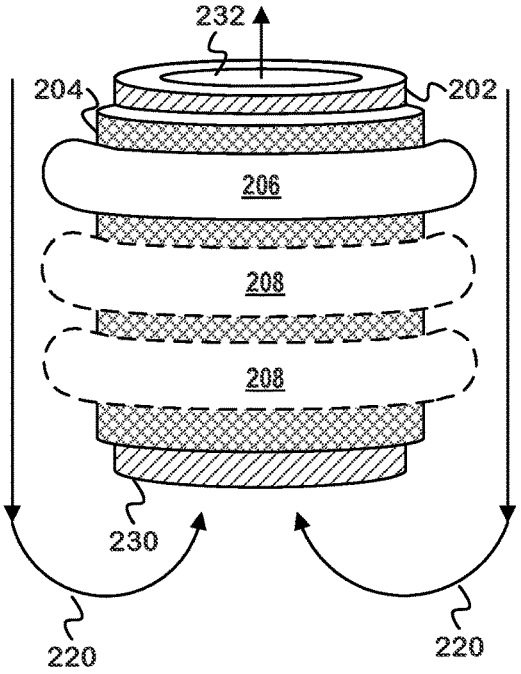
FIGS. 2A and 2B depict views of an example inductance loop fluid detector externally coaxial to a tubular for detecting cement.
Figure 2B:
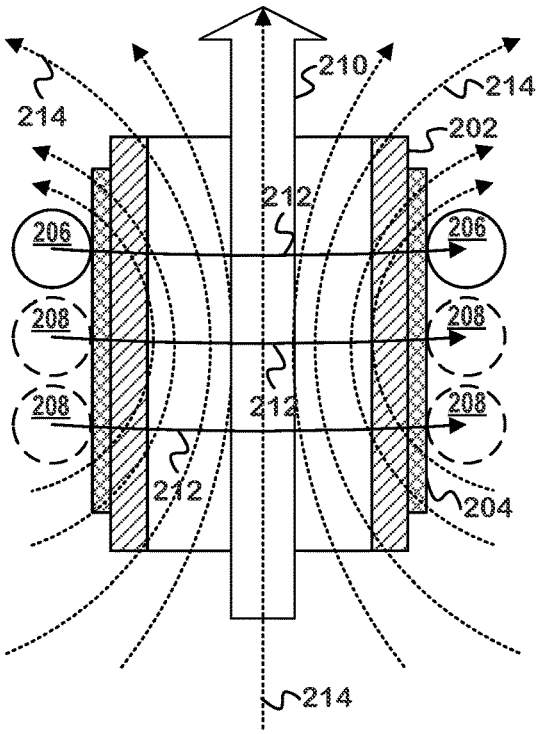

FIGS. 2A and 2B depict views of an example inductance loop fluid detector externally coaxial to a tubular for detecting cement. FIG. 2A depicts a schematic view of the example inductance loop fluid detector coaxially oriented external to a tubular. The view includes a tubular 202, a soft magnetic material 204, a first loop inductor 206, and additional loop inductor 208. The tubular 202 can be any portion of a wellbore tubular (i.e., casing, liner, sleeve, etc.), including those sections of the tubular 202 considered to be part of the shoe. Fluid flow lines 220 indicate fluid flow corresponding to a reverse cementing operation. The tubular 202 can instead be surrounded by fluid flow corresponding to any other wellbore or cementing operation. Fluid, e.g., drilling fluid, drilling mud, wellbore fluid, formation fluid, cement, slurry, hydraulic fluid, displacement mud, etc., is shown as entering the tubular 202 at a lower interface 230 and exiting the tubular at an upper interface 232. The tubular 202 can be connected to one or more additional section of tubular or wellbore equipment, which are not depicted for simplification, at least one of the lower interface 230 and an upper interface 232. The tubular 202 can be of any appropriate diameter and height.

The soft magnetic material 204 separates the first loop inductor 206, and additional loop inductor 208 from the tubular 202 if the tubular 202 is metallic (such as of steel) or magnetic. Embodiments can omit the soft magnetic material 204, for example, if the tubular 202 is a fiberglass or non-magnetic material. The soft magnetic material 204 can be integrated into the tubular 202 or applied to one or more surfaces of the tubular 202 or one or more surfaces of the first loop inductor 206 and additional loop inductors 208. The soft magnetic material 204 can be a ferrite ceramic material (including a ferrite ceramic insulator), amorphous nano-crystal alloy, etc.

Soft magnetic materials are those materials characterized by a low magnetic coercivity ($H_c$). Soft magnetic materials tend to lose magnetization quickly in the absence of an applied magnetic field and to require less energy to magnetize and de-magnetize than hard or permanent magnets. Some materials, compounds, and alloys can form both soft magnetic and hard magnetics—where magnetic characteristics depend on grain size, processing, heat treatment, etc.

Soft magnetic material 204 applied to or integrated with the tubular 202 channels function as magnetic shields of the tubular 202. The soft magnetic material 204 can be separated from the tubular 202 by an insulator or other coating. The soft magnetic material 204 can be separated from the first loop inductor 206, and any additional loop inductor 208 by a coating on the first loop inductor 206 and any additional loop inductor 208 or by a polymer or insulative coating or layer. The soft magnetic material, which can be a non-conductive ferrite material, lies between the conductive casing pipe and the coil to reduce the adverse effect due to magnetization of a metal casing. The magnetic field induced by the coil or resulting from the eddy current can travel to or magnetize a conductive tubular or pipe, which is often manufactured with low-carbon steel material. Tubular magnetization creates a background magnetic field which interferes with measurement of induced magnetic field or current. The soft magnetic material prevents tubular magnetization by effectively shielding the tubular from the magnetic field and therefore limiting the current or magnetic field measurements by the sensor system to those of the fluid.

The first loop inductor 206 and any additional loop inductor 208 comprise one or more conductors arranged in a loop or other geometrically appropriate shape around the tubular 202. The one or more conductors, which may be copper wire, Litz wire, etc., can be coated with an insulator or other protective or polymer coating. The first loop inductor 206 and any additional loop inductor 208 can comprise a single inductor—such as a solenoid for the limit as the number of loops approaches infinity—or can comprise separate inductors arranged in a single or multiple circuit. The first loop inductor 206 and any additional loop inductor 208 can be embedded in the soft magnetic material 204 or a protective coating or layer of the soft magnetic material 204. The additional loop inductor 208 can be omitted.

FIG. 2B depicts a cross-sectional view of the inductance loop fluid detector depicted in FIG. 2A. Flow through of fluid through the tubular is illustrated by the arrow 210. Electric current flowing through the first loop inductor 206 and the additional loop inductors 208 is illustrated by arrows 212. The magnetic field induced by the electric current flow is depicted by the dashed lines and arrows 214, where the magnetic field direction is given by Ampere's law with Maxwell's addition.

The magnetic field, as depicted by the dashed lines and arrows 214, exists within and surrounding the tubular 202, and is generally aligned with the longitudinal axis of the tubular 202. The magnetic field direction depends on the direction of the electric current, where the electric current direction is illustrated by the arrows 212.

The strength and direction of the magnetic field within and surrounding the tubular 202 depend on the permittivity and permeability of the tubular 202, the soft magnetic material 204, and the fluid within and surrounding the tubular 202. A change in fluid which results in a change in fluid electrical and magnetic properties is detectable as a change in the electrical properties of the inductor or inductor circuit, as will be discussed further in reference to FIGS. 6A-B and 7A-B.

Figure 3A:
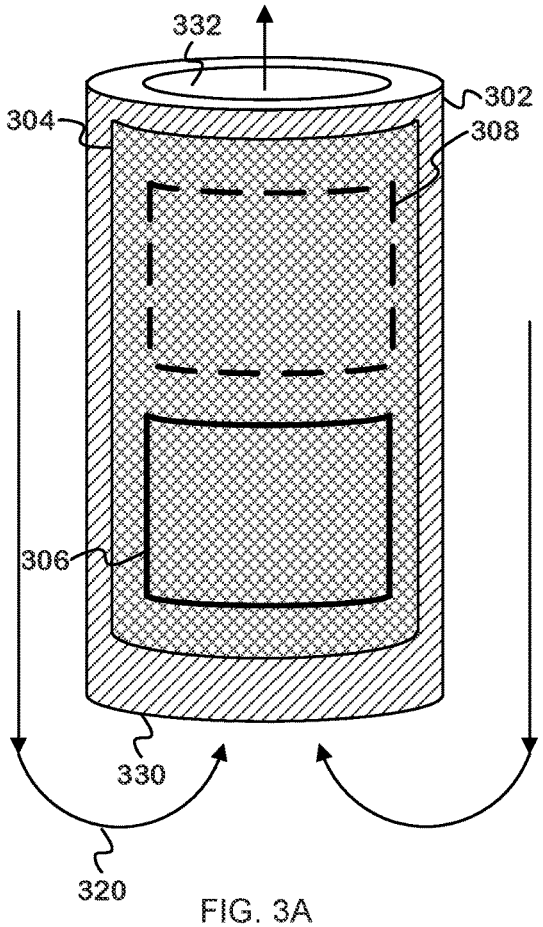
FIGS. 3A and 3B depict views of an example inductance loop fluid detector radially oriented external to a tubular for detecting cement.
Figure 3B:
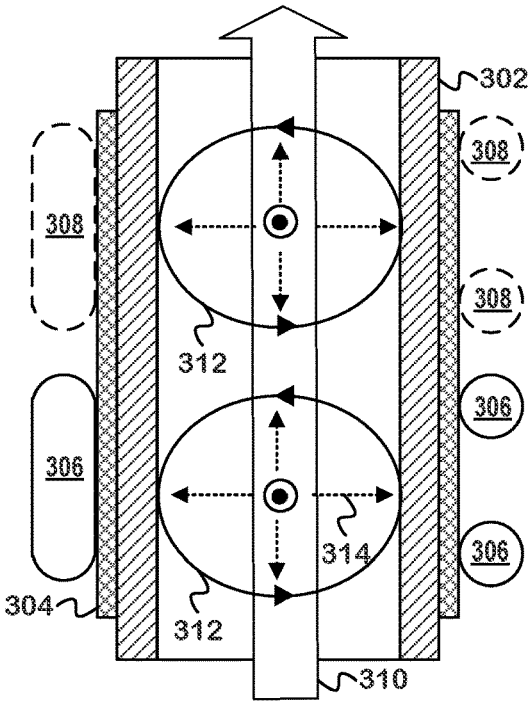

FIGS. 3A and 3B depict views of an example inductance loop fluid detector radially oriented external to a tubular for detecting cement. FIG. 3A depicts a schematic view of the inductance loop fluid detector radially oriented external to a tubular. The view includes a tubular 302, a soft magnetic material 304, a first loop inductor 306, and an additional loop inductor 308. The tubular 302 can be any portion of a wellbore tubular as previously described in reference to FIG. 2A. Fluid flow lines 320 depict fluid flow corresponding to a reverse cementing operation, but which could be any other wellbore or cementing operation instead. Fluid, e.g., drilling fluid, drilling mud, wellbore fluid, formation fluid, cement, slurry, hydraulic fluid, displacement mud, etc., is shown as entering the tubular 302 at a lower interface 330 and exiting the tubular at an upper interface 332. The soft magnetic material 304 is optional, as is the additional loop inductor 308 as previously described. The soft magnetic material 304 and the first loop inductor 306 and the additional loop inductor 308 can have any properties previously described in reference to the materials of FIG. 2A and 2B.

FIG. 3B depicts a cross-sectional view of the inductance loop fluid detector depicted in FIG. 3A. Flow through of fluid through the tubular is illustrated by the arrow 310. Example directions of electric currents flowing through the first loop inductor 306 and the additional loop inductors 308 are indicated by the looping arrows 312. The electric current flows through a circuit comprising at least the first loop inductor 306 and additional circuitry, such as a current or voltage source, resistor, ammeter or voltmeter, etc. The magnetic field induced by the depicted example electric current flow is represented by the dashed lines and arrows 314. In this instance the magnetic field vectors point perpendicular to the axis of the tubular 302, both through the fluid in the tubular 302 and out of the wall of the tubular.

Figure 4A:
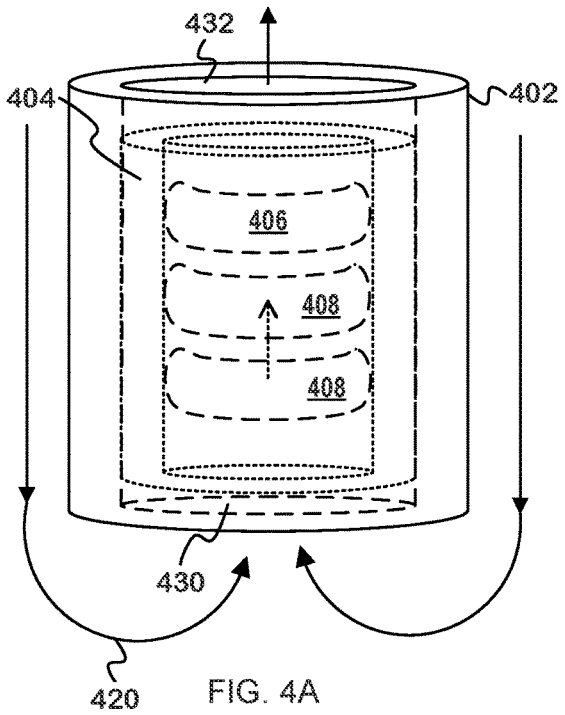
FIGS. 4A and 4B depict views of an example inductance loop fluid detector internally coaxial to a tubular for detecting cement.
Figure 4B:
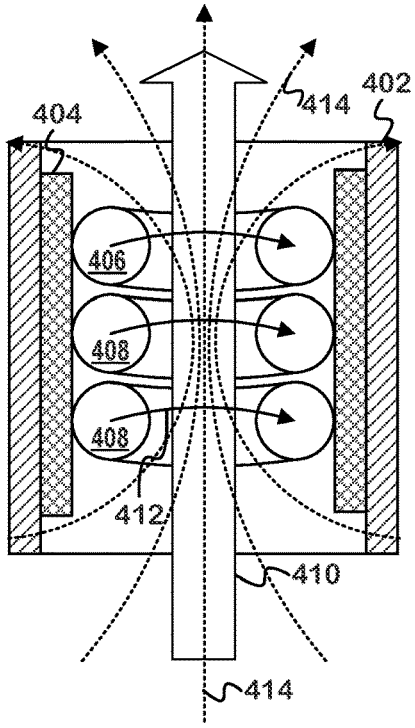

FIGS. 4A and 4B depict views of an example inductance loop fluid detector internally coaxial to a tubular for detecting cement. FIG. 4A depicts a partially transparent schematic view of the inductance loop fluid detector internally coaxial to a tubular. The view includes a tubular 402, a soft magnetic material 404, a first loop inductor 406, and additional loop inductor 408. The soft magnetic material 404, the first loop inductor 406, and the additional loop inductors 408 lie within a cavity of the tubular 404 and are depicted using dashed lines. The tubular 404 can be any portion of a wellbore tubular as previously described in reference to FIG. 2A. Fluid flow lines 420 depict fluid flow corresponding to a reverse cementing operation, but which could be any other wellbore or cementing operation instead.

Fluid is shown as entering the tubular 402 at a lower interface 430 and exiting the tubular at an upper interface 432. The soft magnetic material 404 is optional, as are the additional loop inductors 408 as previously described. The soft magnetic material 404 and the first loop inductor 406 and the additional loop inductor 408 can have any properties previously described in reference to the materials of FIGS. 2A-2B and 3A-3B.

FIG. 4B depicts a cross-sectional view of the inductance loop fluid detector of FIG. 4A. Flow of fluid through the tubular is illustrated by the arrow 410. Example directions of electric currents flowing through the first loop inductor 406 and the additional loop inductors 408 are indicated by arrows 412. The electric current flows through a circuit comprising at least the first loop inductor 406 and additional circuitry, such as a current or voltage source, resistor, ammeter or voltmeter, etc. The magnetic field, as depicted by the dashed lines and arrows 414, exists within and surrounding the tubular 402 and is generally aligned with the longitudinal axis of the tubular 402. The magnetic field magnitude and direction depends on the direction of the electric current, where the electric current direction is illustrated by the arrows 412.

Figure 5A:
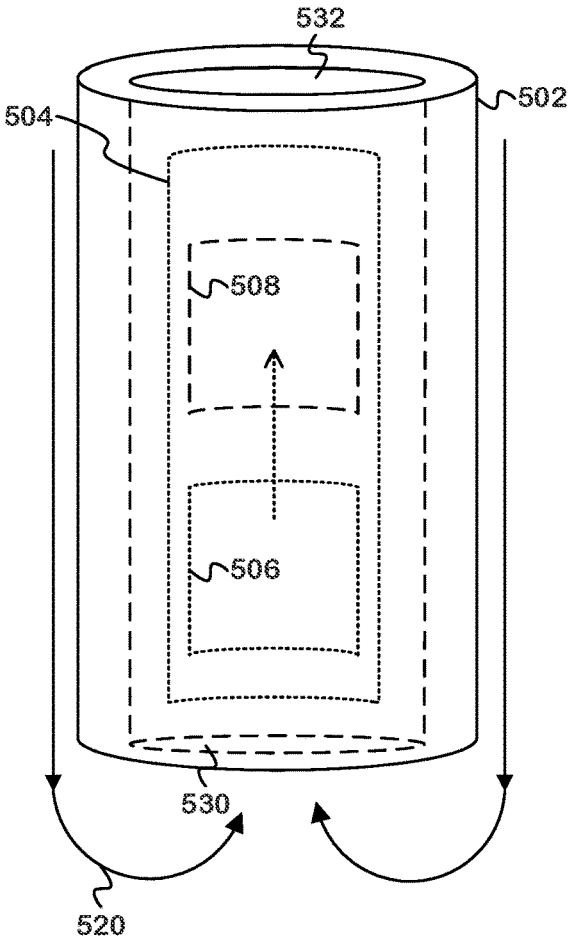
FIGS. 5A and 5B depict views of an example surface inductance loop fluid detector radially oriented internal to a tubular for detecting cement.
Figure 5B:
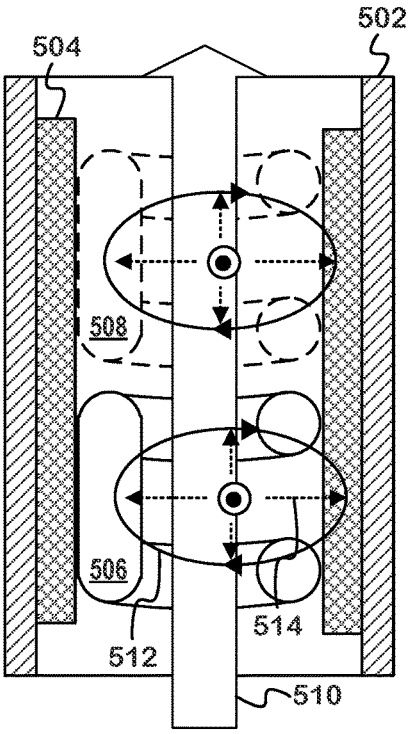

FIGS. 5A and 5B depict views of an example surface inductance loop fluid detector radially oriented internal to a tubular for detecting cement. FIG. 5A depicts a schematic view of the surface inductance loop fluid detector radially oriented internal to a tubular. The view includes a tubular 502, a soft magnetic material 504, a first loop inductor 506, and an additional loop inductor 508. The soft magnetic material 504, the first loop inductor 506, and the additional loop inductors 508 lie within a cavity of the tubular 502 and are depicted using dashed lines. The tubular 502 can be any portion of a wellbore tubular as previously described in reference to FIG. 2A. The tubular 502 is depicted as surrounded by fluid flow lines 520 corresponding to a reverse cementing operation, but which could be any other wellbore or cementing operation instead. Fluid is shown as entering the tubular 502 at a lower interface 530 and exiting the tubular at an upper interface 532. The soft magnetic material 504 is optional, as is the additional loop inductor 508 as previously described. The soft magnetic material 504 and the first loop inductor 506 and the additional loop inductor 508 can have any properties previously described in reference to the materials of FIGS. 2A and 2B.

FIG. 5B depicts a cross-sectional view of the surface inductance loop fluid detector of FIG. 5B. Flow of fluid through the tubular is illustrated by the arrow 510. Example directions of electric currents flowing through the first loop inductor 506 and the additional loop inductors 508 are indicated by the looping arrows 512. The electric current flows through a circuit comprising at least the first loop inductor 506 and additional circuitry, such as a current or voltage source, resistor, ammeter or voltmeter, etc. The magnetic field induced by the depicted example electric current flow is represented by the dashed lines and arrows 514. In this configuration, the magnetic field vectors point perpendicular to the axis of the tubular 502, both through the fluid in the tubular 302 and out of the wall of the tubular.

Figure 6B:
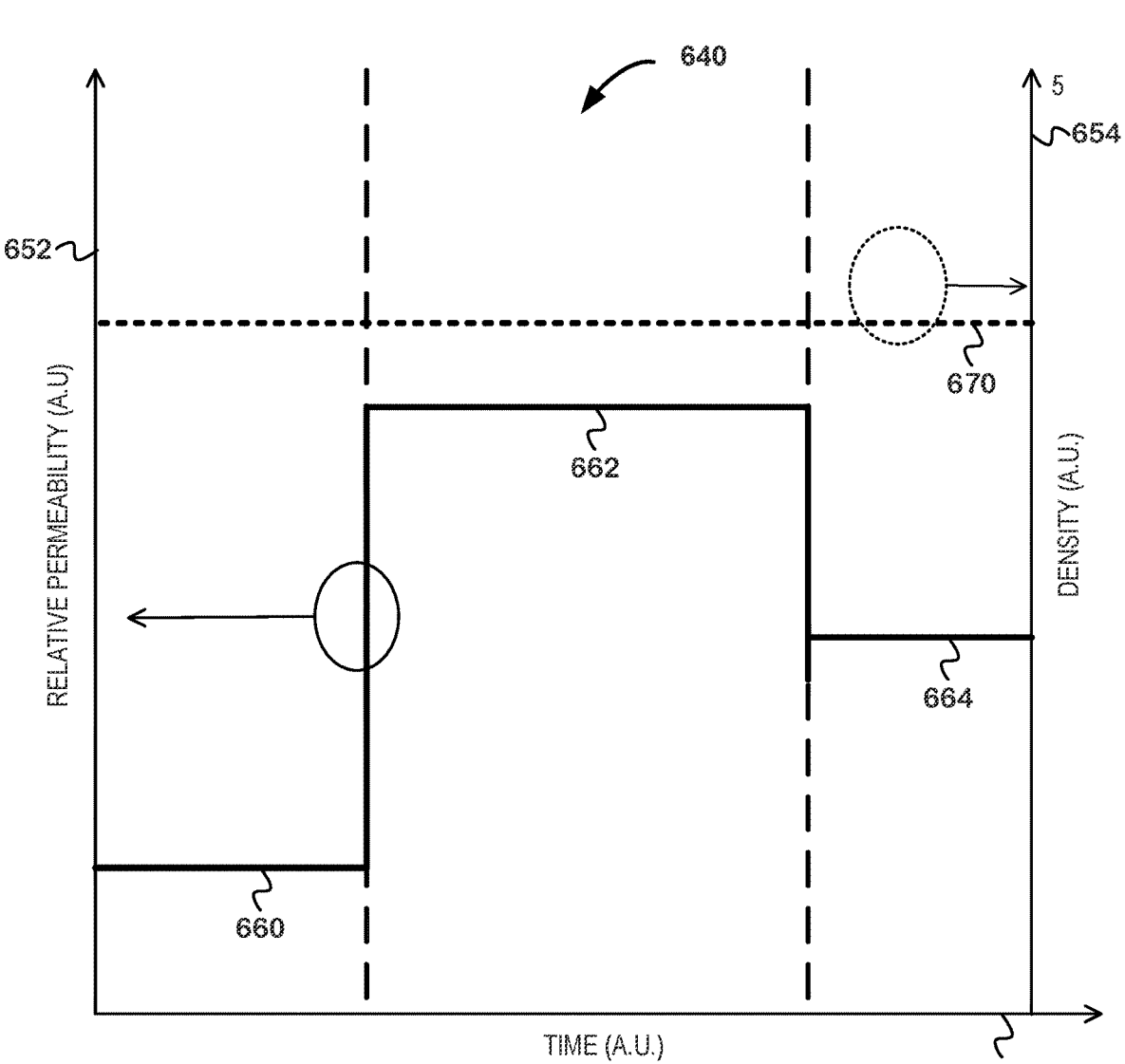
FIGS. 6A and 6B illustrate an example single phase dopant profile during a cementing operation.
Figure 6A:
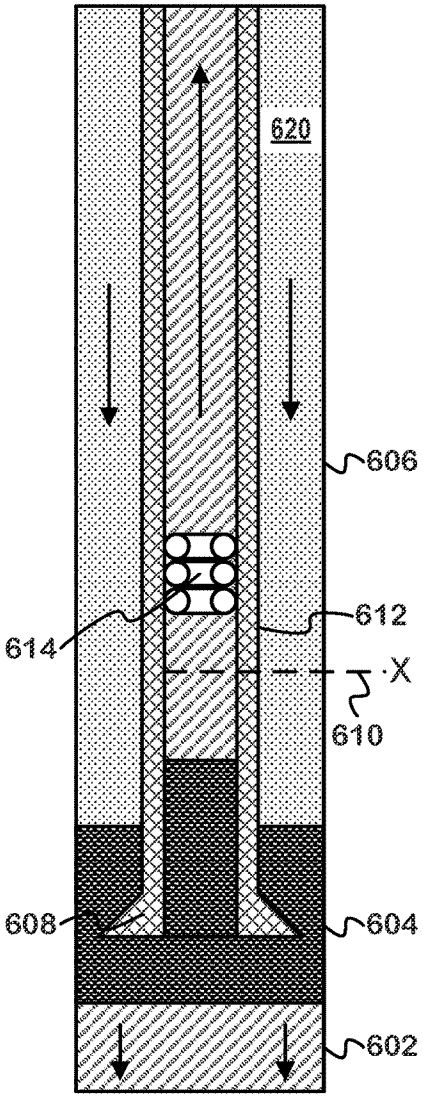

FIG. 6A and 6B illustrate an example single phase dopant profile during a cementing operation. FIG. 6A is a schematic cross-sectional view of a wellbore with various wellbore fluids and an inductor for monitoring cementing, depicted during reverse cementing. The wellbore is depicted as containing wellbore fluid 602, a doped fluid 604, and an undoped cement slurry 606. The wellbore fluid 602 can comprise one or more of drilling fluid, drilling mud, formation fluid, hydraulic fluid, displacement mud, etc. The wellbore fluid 602 can be an oil-based mud or a water-based mud. The electrical properties of an oil-based wellbore fluid are predominantly non-conductive. The electrical properties of a water-based mud can be non-conductive if the water is fresh but will be conductive if the water is saltwater or has a significant saline component. The doped fluid 604 can be a doped cement slurry or a doped hydraulic fluid, stabilization fluid, separation fluid, etc. The doped fluid 604 can also be a doped portion of either the wellbore fluid 602 or the cement slurry 606. The undoped cement slurry 606 can be any appropriate cement, cement slurry, fluid comprising cement, etc. During reverse cementing, the fluids travel down an annulus 620 and into a casing 608. An inductive loop sensor 614 is depicted within the casing 608. The inductive loop sensor 614 can instead be located external to the casing 608 or in any other orientation as previously described. A dashed line 610 indicates a position X internal to the casing 608. The properties of the fluid at the position X are illustrated in FIG. 6B.

FIG. 6B is a graph depicting example fluid properties for a reverse cementing operation controlled by the inductive loop sensor of FIG. 6A and based on a single-phase dopant profile. A graph 640 depicts relative permeability (in arbitrary units) on primary y-axis 652 and density (in arbitrary units) on secondary y-axis 654 as a function of time (displayed in arbitrary units on x-axis 650). The fluid properties correspond to those of the fluids passing the position X marked by the dashed line 610 in FIG. 6A. In this example, the density of each of the fluids is constant, as represented by dashed line 670 graphed against the secondary y-axis 654. Alternatively, the density of any or all of the fluids can vary with depth or time. The relative permeabilities of the fluids vary, however, and therefore the relative permeability at the position X varies with time. The relative permeability of the wellbore fluid 602 (of FIG. 6A) is indicated by value 660. The relative permeability of doped fluid 604 is indicated by value 662. The relative permeability of the undoped cement slurry 606 is indicated by value 664. In this example, the relative permeability of each fluid is shown as constant but can alternatively vary with depth or time—such as linearly. Further, the boundaries between each fluid are shown as a sharp delineation, but boundaries can instead occur over a range of times or depths and permeabilities can vary due to fluid mixing.

The difference in permeability between the wellbore fluid 602 and the doped fluid 604 alters the electrical and magnetic characteristics of the inductive loop sensor 614, which allows the change in fluids to be detected. Instead of permeability, a difference in conductivity between the wellbore fluid 602 and the doped fluid 604 can alter the electrical and magnetic characteristics of the inductive loop sensor 614 and allow the change in fluids to be detected.

The relative permeability and conductivity of various wellbore materials and cement dopants are listed below, in Table 1. Oil-based muds can have relative permeabilities and conductivities similar to hydrocarbons—where both permeability and conductivity is low. Water-based muds can have relative permeability and conductivities similar to water, where either fresh water and saltwater or seawater can be a major component of water-based muds. Wellbore fluid can further contain formation fluid, which enters the wellbore from the formation, and cuttings and other formation or drilling debris, which can alter the relative permeability and conductivity of the drilling mud or other wellbore fluid. Selection of a doping agent (i.e., dopant) relies on knowledge of the wellbore fluid and cement properties. At least one of the relative permeability and conductivity of the dopant is selected such that the inductance of the doped fluid 604 is sufficiently different from the wellbore fluid 602 that the detection threshold or triggering criterion (as described in Equation 1 or another suitable relationship) is satisfied when the doped fluid 604 replaces the wellbore fluid 602 in the magnetic field of the inductive loop sensor 614.

TABLE 1

Relative Permeability and Conductivity Values for Example Wellbore Substances

| Material | Chemical Formula | Relative Permeability $\mu_r$ | Conductivity (S/m) |
|---|---|---|---|
| Water | $H_2O$ | 0.99992 | 1.00000037 |
| Sea Water | $H_2O$ + HCl, etc. | 81 | 4.8 |
| Steel | $Fe_xC_y$ | 750 to 4000 | 1.4 to $6 \times 10^6$ |
| Soft Magnetic Material | FeX | 100 to $5 \times 10^5$ | 100 to $4 \times 10^6$ |
| Hydrocarbon | $C_xH_{2x}$ | 4 | 0.001 |
| Cement | $3CaO \cdot SiO_2$, $2CaO \cdot SiO_2$ $3CaO \cdot Al_2O_3$, $4CaO \cdot Al_2O_3Fe_2O_3$, etc. | ~1 | $10^{-7}$ to $10^{-2}$ |
| Air | 78.09% $N_2$, 20.95% $O_2$ | 1.00000037 | ~$10^{-15}$ to $10^{-9}$ |
| Ferrite | $M \cdot Fe_xO_y$, M = Ni, Zn, Mn, Co, Sr, Ba, etc. | 2200+ | $5 \times 10^{-2}$ to 5 |

A change in magnetic permeability or conductivity in the vicinity of an inductor causes a change in inductance. In a simple resistor, inductor, capacitor series circuit (also known as an RLC circuit where R is the effective resistance of a resistor, L is the inductance of an inductor, and C is the capacitance of a capacitor), the voltage is given by application of Kirchhoff's voltage law as Equation 3 and 4, below:

$$V(t) = V_R + V_L + V_C \tag{3}$$

$$V(t) = RI(t) + L\frac{dI(t)}{dt} + V(0) + \frac{1}{C}\int_0^t I(\tau)d\tau \tag{4}$$

where V(t) is the voltage from the source as a function of time, I(t) is the current as a function of time, and the voltage drop over a resistor is given by $V_R$=RI(t), the voltage drop over an inductor of constant inductance L is given by $$V_L = L\frac{dI(t)}{dt},$$

and the voltage drop over a capacitor is given by $$V_C = \frac{1}{C}\int_0^t I(\tau)d\tau.$$

When both electric fields and magnetic fields vary, the relationship between a time-varying magnetic field and varying electric field are governed by the Maxwell-Faraday equations as shown in Equations 5 and 6, below:

$$\nabla \times E = -\frac{\partial B}{dt} \tag{5}$$

$$\oint_{\partial\Sigma} E \cdot dl = -\int_{\Sigma}\frac{\partial B}{\partial t} \cdot dA \tag{6}$$

where ∇ is the curl operator, E is the electric field as a function of time (which is a vector quantity), B is the magnetic field as a function of time (also a vector quantity), Σ is the surface enclosed by the contour ∂Σ, dl is an infinitesimal vector length of the contour ∂Σ, and dA is an infinitesimal vector area of the surface Σ. For a non-changing surface, this simplifies to $$\oint_{\partial\Sigma} E \cdot dl = -\frac{d}{dt}\int_{\Sigma} B \cdot dA \tag{7}$$

As a flowing electric current generates a magnetic field, the ratio between the current which creates the magnetic field and the induced magnetic field is known as the inductance, where inductance is defined as Equation 8, below:

$$L = \frac{\Phi_B}{I} \tag{8}$$

This relationship can be substituted into Faraday's law of induction to get a relationship for the electromotive force given by Equation 9:

$$\varepsilon = -\frac{d\Phi_B}{dt} = -\frac{d(LI)}{dt} \tag{9}$$

Inductance of a circuit or circuit element depends on the geometry of the current flow and on the magnetic permeability of surrounding materials. In cases where both inductance L and current I are functions of time, the electromotive force is then given by the product rule for derivatives as Equation 10:

$$\varepsilon = -\frac{d\Phi_B}{dt} = -I\frac{dL}{dt} - L\frac{dI}{dt} \tag{10}$$

In cases where inductance is constant, the first term is zero because is $$\frac{dL}{dt}$$

zero. However, in instances where the inductance changes over time, due to change in geometry or magnetic permeability, the first term is non-zero. This happens, for instance, when fluid with varying magnetic permeability passes through the loops of an inductor loop sensor.

If the magnetic permeability is the only inductor characteristic which varies with time, then the time variation of inductance for a wire loop simplifies to Equation 11, below:

$$\frac{dL}{dt} = \frac{d}{dt}\left(\frac{\mu_r \mu_0 A}{l} F'\right) = \frac{\mu_0 A}{l} F' \frac{d\mu_r}{dt} \tag{11}$$

where $\mu_r$ is the relative permeability of the core, $\mu_0$ is the vacuum permeability (which is $4\pi\times10^{-7}$ H/m (henry per meter)), A is the cross-sectional area of the loop, l is the length of the coil, and F' is a non-uniformity or geometrical fitting factor. Eq. 11 shows that the derivative of inductance with respect to time is proportional to the derivative of magnetic permeability with respect to time when all other variables are constant. The change in inductance can be both an increase, due to an increase in the magnetic permeability of the fluid within the inductor loop sensor, or a decrease, due to a decrease in the magnetic flux due to eddy current effects.

Figure 7B:
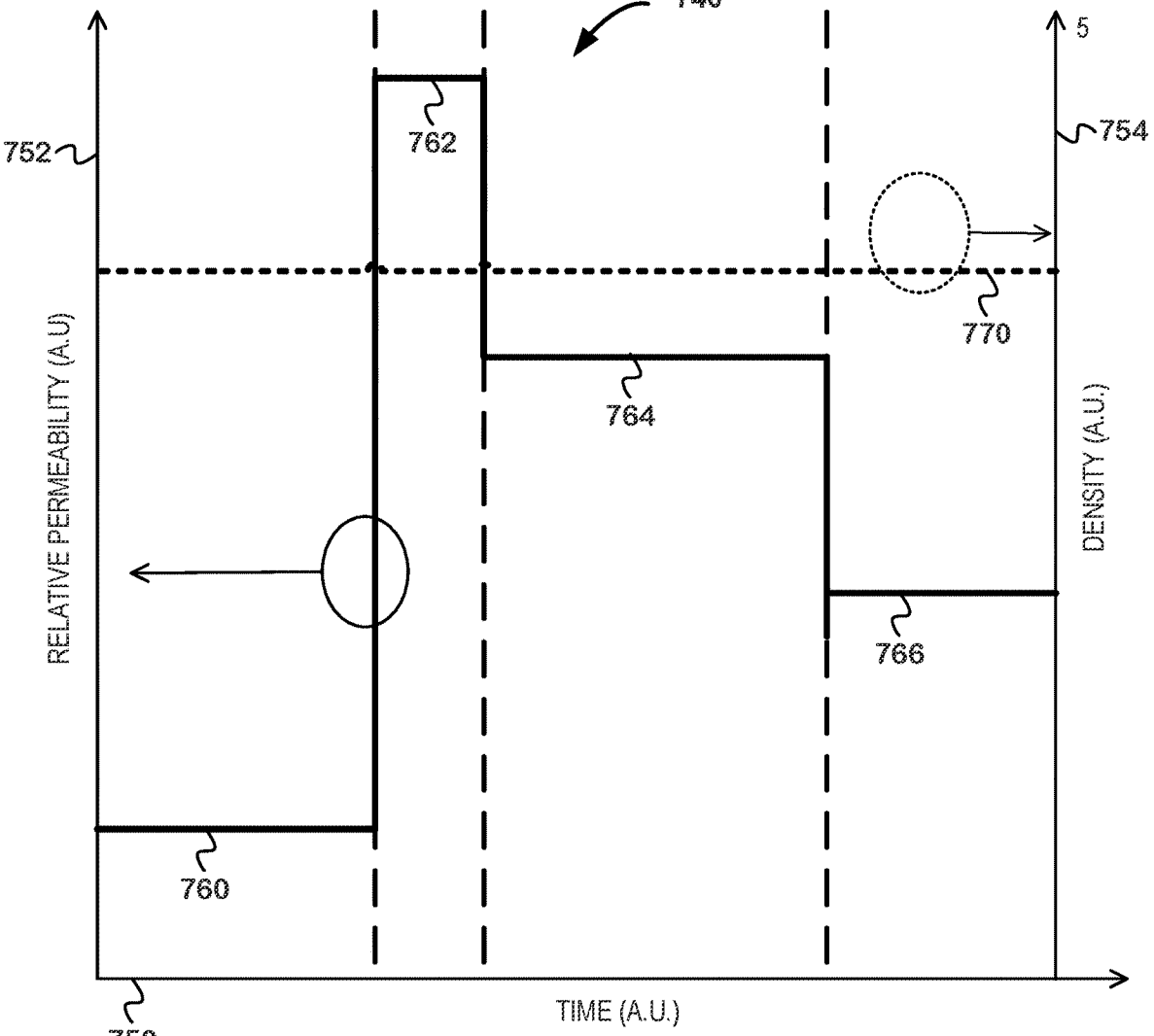
FIGS. 7A and 7B illustrate an example two phase dopant profile during a cementing operation.
Figure 7A:
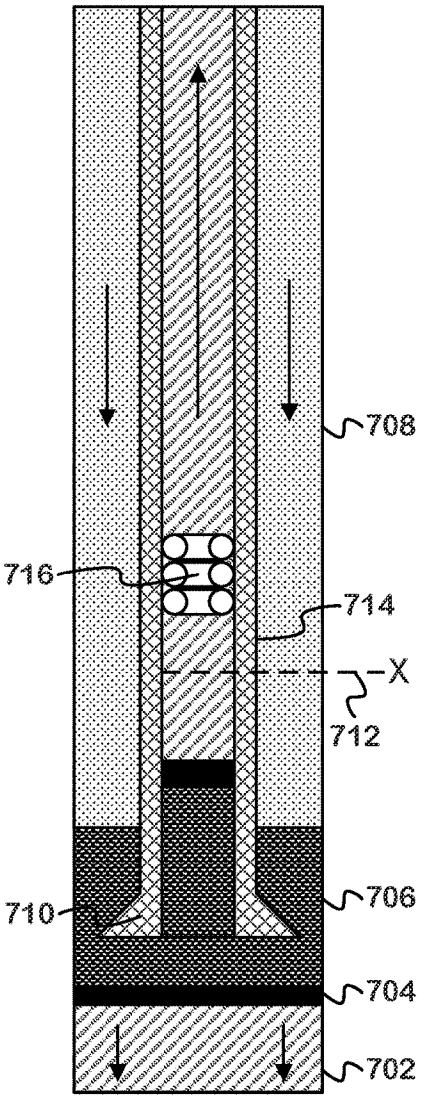

FIGS. 7A and 7B illustrate an example two phase dopant profile during a cementing operation. FIG. 7A is a schematic cross-sectional view of a wellbore with various wellbore fluids and an inductor for monitoring cementing, depicted during reverse cementing. The wellbore is depicted as containing wellbore fluid 702, a first doped fluid 704, a second doped fluid 706, and an undoped cement slurry 708. The wellbore fluid 702 can be any fluid as previously described in reference to FIG. 6A. The first doped fluid 704 and the second doped fluid 706 can be doped cement slurry or any other fluid as previously described. The first doped fluid 704 is more strongly doped than the second doped fluid 706. The undoped cement slurry 708 can be any appropriate cement, cement slurry, fluid comprising cement, etc. During reverse cementing, the fluids travel down an annulus and into a casing 710. An inductive loop sensor 716 is depicted within the casing 710. The inductive loop sensor 716 can instead be located external to the casing 710 or in any other orientation as previously described. A dashed line 712 indicates a position X internal to the casing 710. The properties of the fluid at the position X are illustrated in FIG. 7B.

FIG. 7B is a graph depicting example fluid properties for a reverse cementing operation controlled by the inductive loop sensor of FIG. 7A and based on a double-phase dopant profile. A graph 740 depicts relative permeability (in arbitrary units) on primary y-axis 752 and density (in arbitrary units) on secondary y-axis 754 as a function of time (displayed in arbitrary units on x-axis 750). The fluid properties correspond to those of the fluids passing the position X marked by the dashed line 712 in FIG. 7A. In this example, the density of each of the fluids is constant, as represented by dashed line 770 graphed against the secondary y-axis 754. The relative permeabilities of the fluids vary and therefore the relative permeability at the position X varies with time. The relative permeability of the wellbore fluid 702 (of FIG. 7A) is indicated by value 760. The relative permeability of the first doped fluid 704 is indicated by value 762. The relative permeability of the second doped fluid 706 is indicated by the value 764. The relative permeability of the undoped cement slurry 708 is indicated by value 766. In this example, the relative permeability of each fluid is shown as constant but can alternatively vary and boundaries can instead occur over a range of times or depths and permeabilities can vary due to fluid mixing.

The first doped fluid 704 is present in a smaller amount or volume but with a greater dopant amount or concentration than that present in the second doped fluid 706. The first doped fluid 704 can be a different fluid and may contain different dopants than the second doped fluid 706. The first doped fluid 704 can be used to separate the cement slurry 708 and the wellbore fluid 702, including by density, gravitational, or solubility stratification.

Figure 8:
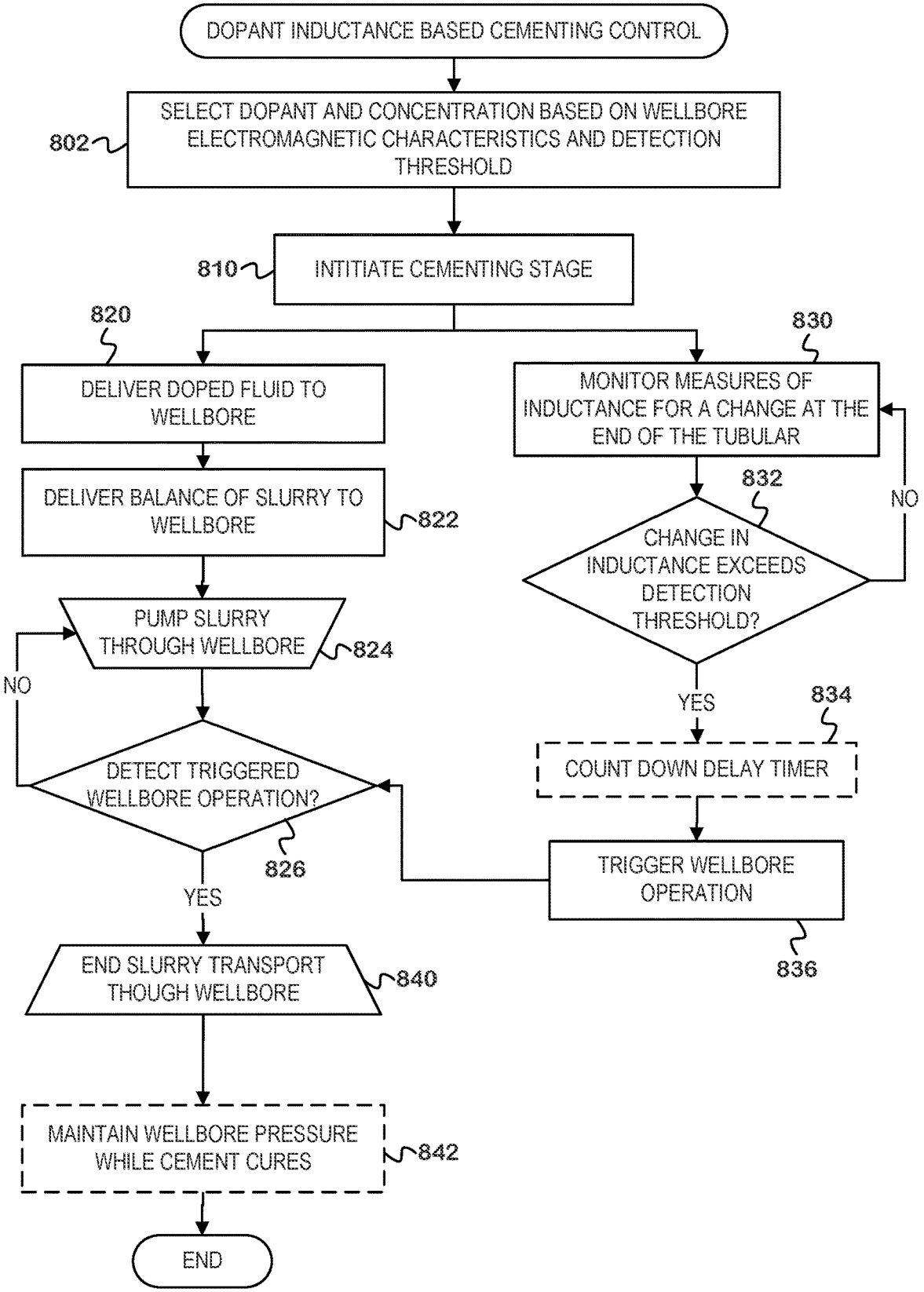
FIG. 8 is a flowchart of example operations for monitoring inductance during a cementing operation.

FIG. 8 is a flowchart of example operations for monitoring inductance during a cementing operation. The example operations are described with reference to a wellbore fluid inductance monitor, and an inductance loop cement detector for consistency with the earlier figures(s). For simplicity, operations performed in the wellbore are described as performed by the wellbore fluid inductance monitor, but can be performed by either the wellbore fluid inductance monitor or the inductance loop cement detector. Operations performed at a location other than at the end of a tubular in the wellbore, such as at the surface, at another depth in the wellbore, on the drilling right, at the cement or slurry source, or at the slurry dopant source are described as performed by a cementing controller. Operations of the cementing controller can be performed by one or more controllers at one or more locations. Operations described as performed by the wellbore fluid inductance monitor and the cementing controller can occur asynchronously. The name chosen for the program code is not to be limiting on the claims. Structure and organization of a program can vary due to platform, programmer/architect preferences, programming languages, etc. In addition, the names of code units (programs, modules, methods, functions, etc.) can vary for the same reasons and be arbitrary.

At block 802, the cementing controller selects a dopant and dopant concentration based on electromagnetic characteristics of a wellbore and a detection threshold of the wellbore fluid inductance monitor. The dopant can be any fluid, solid, particulates, suspension, colloid, etc. and can be delivered in powdered form to wet or dry cement or slurry. Alternatively, the dopant can be delivered in a fluid other than cement or slurry. The dopant is selected for at least one of its magnetic or electrical properties from a set of cement or concrete additives that are supportable in the slurry and do not degrade cement performance. The slurry dopant is density matched to the concrete or slurry density or wellbore fluid density such that gravitational segregation is substantially negligible. The dopant concentration is selected such that the dopant containing fluid exhibits at least one of a magnetic permeability and conductivity, which contrasts sufficiently with those properties of the wellbore fluid that the change in inductance which occurs when the dopant containing fluid displaces the wellbore fluid exceeds the inductive change sensitivity threshold. The cementing controller determines dopant identity based on dopant availability, dopant electromagnetic properties, dopant supportability limits, and dopant cost.

At block 810, the cementing controller initiates the cementing operation. The cementing operation can be a reverse cementing operation, or any other cementing operation. From block 810, the cementing operation continues to block 820 where the cementing controller performs operations at the surface (or other location) and to block 830 where the wellbore fluid inductance monitor performs operations at the end of the tubular.

At block 820, the cementing controller delivers the doped fluid to the wellbore. The doped fluid is delivered to the annulus (in a reverse cementing operation) or other location as appropriate from the cement or slurry source or the cement dopant source. The doped fluid can be a doped cement slurry, displacement fluid, separation fluid, etc. In some instances, a cement slurry can be a doped fluid (i.e., can have a sufficiently high magnetic permeability, inductance, or conductivity contrast with the wellbore fluid) without extraneous doping. Cement slurries contain a variety of components, which can be considered dopants even if traditionally used in cementing operations.

At block 822, the cementing controller delivers the balance of the cement or slurry to the wellbore. The balance of the cement or cement slurry can be undoped or traditional cement. The volume of the cement or slurry is calculated based on the drilled wellbore volume, geological factors, caliper measurements, or any other standard cement volume calculation. The total volume of cement delivered comprises both the doped and undoped portions, which may make up various percentages of the total cement volume. For instance, the doped fluid can be doped cement which comprises 1% of the total cement volume, with undoped or cement comprising 99% of the total cement volume. Alternatively, if the doped fluid is not a doped cement (e.g., the doped fluid is a doped displacement fluid) then the undoped cement slurry can comprise 100% of the total cement volume. In some instances, undoped cement can contain one or more components considered to be magnetic or electrical dopants in the doped fluid, but in smaller quantities (or in uncontrolled amounts) than found in doped fluid.

At block 824, the cementing controller pumps the cement slurry and doped fluid through the wellbore—i.e., through the annulus or another passage. The pumping can be accomplished through hydraulic pressure means, by pumping additional fluid into the annulus or other passage and by removing fluid (such as wellbore fluid) from a return passage. If the entire wellbore is to be cemented, the pumping fluid can be cement slurry, including various batches or stages of cement slurry. If only a portion of the wellbore is to be cemented, the pumping fluid can change to a hydraulic fluid once the balance of the cement slurry is delivered to the wellbore. The cementing controller pumps the cement slurry and doped fluid through the wellbore to deliver the cement slurry to the location to be cemented. The cementing controller stops pumping cement slurry through the well when the cementing controller detects a change in pressure or fluid flow caused by a wellbore operation performed downhole by the wellbore fluid inductance monitor.

At block 826, the cementing controller determines if a triggered wellbore operation is detected. The triggered wellbore operation can be detected as a change in pressure, flow rate, flow volume, or any other signal method (e.g., a mud pulse, an electrical signal, an optical signal, etc.). If no triggered wellbore operation is detected, flow continues to block 824 where pumping of cement slurry through the wellbore continues. If a triggered wellbore operation is detected, flow continues to block 840 where transport of cement slurry through the wellbore is ended.

At block 830, the wellbore fluid inductance monitor monitors measures of inductance for a change at the end of the tubular. The wellbore fluid inductance monitor periodically measures at least one measure of inductance and compares the measure of inductance to a previous value, threshold value, etc. in order to detect a change in inductance. The measure of inductance can be measured at each of a time interval, monitored continually, or actively monitored for a change in one or more electrical values. The measure of inductance for each instance can be a directly calculated value of inductance, or a measure of inductance (e.g., another quantity related to inductance such as resonance frequency in an RLC circuit) can be calculated without a direct calculation of an inductance value. The wellbore fluid inductance monitor includes one or more inductance loop sensors as previously described. The wellbore fluid inductance monitor monitors at least one of a current, voltage, or frequency of an electrical circuit containing the one or more inductance loop sensors.

At block 832, the wellbore fluid inductance monitor determines if a change in inductance exceeds a detection threshold. The wellbore fluid inductance monitor may directly calculate an inductance value, or determine a change in inductance based on at least one of a change in voltage, a change in current, or a change in frequency of an electrical circuit containing one or more inductance loop sensors. The detection threshold may be a value of inductance, a value of current, a value of voltage, a frequency value, etc. based on the value measured at the electrical circuit comprising an inductor. The wellbore fluid inductance monitor may compare a change in inductance to multiple detection thresholds, where each of the multiple detection thresholds can correspond to a separate wellbore operation trigger. The wellbore fluid inductance monitor can also determine that a change in inductance does not correspond to noise by determining a duration of the change or statistical significance of such a change. If a change in inductance exceeds the detection threshold, flow continues to block 834. If no change in inductance exceeds the detection threshold, flow continues to block 830 where the wellbore fluid inductance monitor continues to monitor inductance.

At block 834, the wellbore fluid inductance monitor optionally counts down a delay timer before triggering a wellbore operation. The delay timer can be of a duration to allow the doped fluid to pass fully into the tubular—where such a time length depends on volume of the doped fluid and pumping speed—such that the doped fluid forms no or little portion of the cured cement outside the tubular. This is useful especially in cases where the doped fluid is not a cement slurry or where the doped fluid is to be drilled out during subsequent drilling inside of the cemented tubular (e.g., casing).

At block 836, the wellbore fluid inductance monitor triggers a wellbore operation. The wellbore fluid inductance monitor can trigger one or more wellbore operations. The triggered wellbore operation is a wellbore operation, such as the firing of a percussive sleeve or placing of a plug, that is detectable at the cementing controller. The wellbore operation is one that blocks cement or fluid from entering or passing through the tubular, or otherwise redirects or stops fluid flow or increases fluid pressure. The wellbore operation can further include communication with the cementing controller—such as an analog or digital signal—or an additional indirect communication such as that delivered by a change in pressure, volume, etc. From block 836, flow continues to block 826 where the triggered wellbore operation is detected by the cementing controller. The cementing controller determines that the cement is in location, and ends further transport of the cement slurry through the wellbore in response to the detected triggered wellbore operation.

At block 842, the cementing controller optionally maintains pressure while the cement slurry cures. The cementing controller can maintain the location of the delivered cement and pressure on the cement and wellbore by adjustments to pressure within the annulus and the tubular via pumping at the surface or one or more locations one each side of the delivered cement slurry. In some instances, continues pressure maintenance may be omitted, such as if the pore pressure is low enough that formation fluid influx is unlikely, or if the cement is dense enough in a vertical well to avoid upward flow.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. For example, the operations depicted in blocks 804 and 810 can be performed in parallel or concurrently. With respect to FIG. 8, a delay timer is not necessary. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

Figure 9:
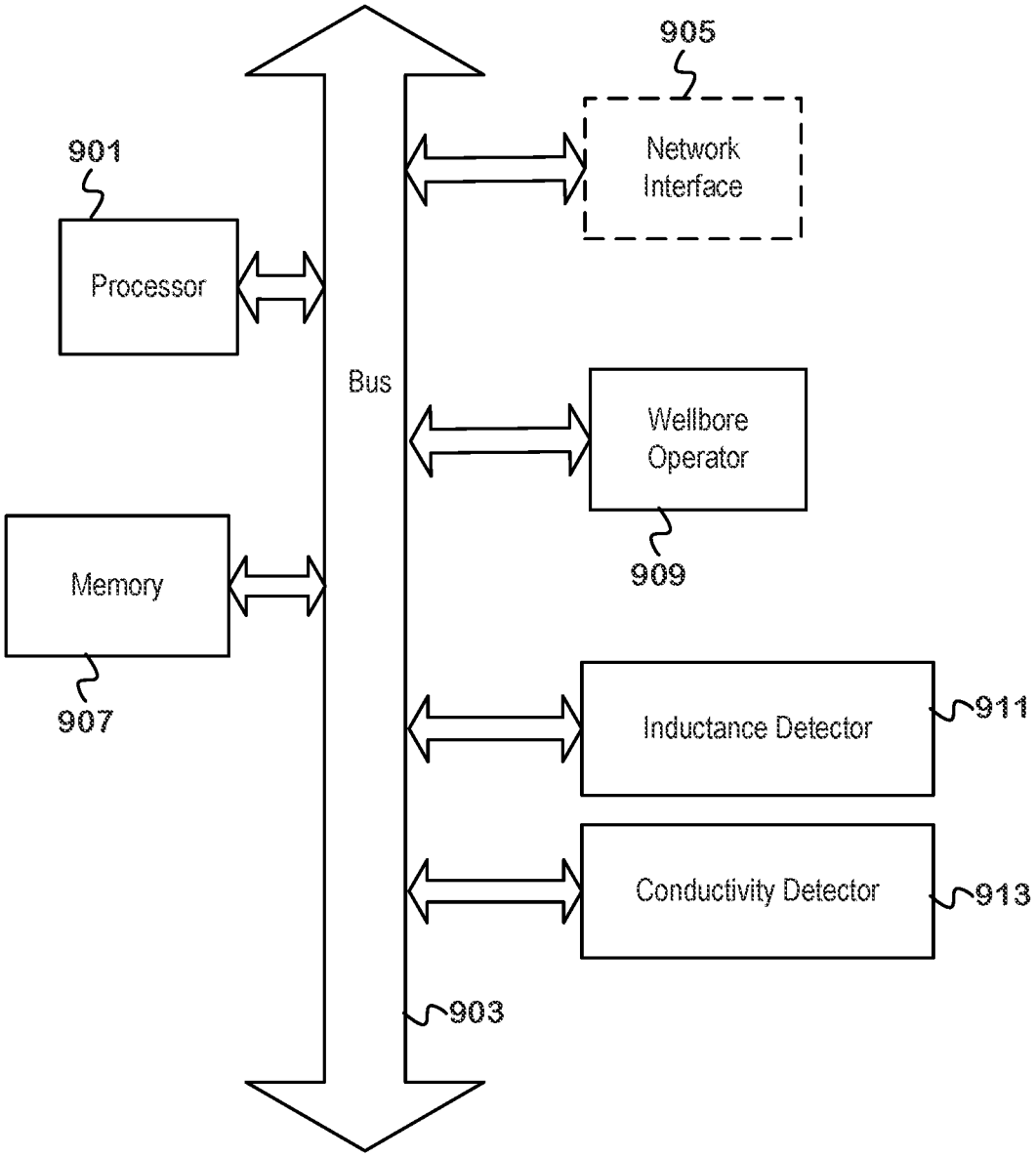
FIG. 9 depicts an example computer system for detecting inductance changes and controlling cementing.

FIG. 9 depicts an example computer for detecting inductance changes and controlling cementing. The computer system includes a processor 901 (possibly including multiple processors, multiple cores, multiple nodes, and/or implementing multi-threading, etc.). The computer system includes memory 907. The memory 907 may be system memory or any one or more of the above already described possible realizations of machine-readable media. The computer system also includes a bus 903 and a network interface 905. The system communicates via transmissions to and/or from remote devices via the network interface 905 in accordance with a network protocol corresponding to the type of network interface, whether wired or wireless and depending upon the carrying medium. In addition, a communication or transmission can involve other layers of a communication protocol and or communication protocol suites (e.g., transmission control protocol, Internet Protocol, user datagram protocol, virtual private network protocols, etc.). The system also includes an inductance detector 911, a conductivity detector 913, and a wellbore operator 909. The inductance detector 911 operates to detect inductance or a change in inductance. The conductivity detector 913 is optional and can function together with the inductance detector 911. The wellbore operator 909 is a trigger or other communication with one or more wellbore operations. The wellbore operator 909 may instead be a wellbore operation 909 in communication with the computer for detecting inductance changes and controlling cementing. Any one of the previously described functionalities may be partially (or entirely) implemented in hardware and/or on the processor 901. For example, the functionality may be implemented with an application specific integrated circuit, in logic implemented in the processor 901, in a co-processor on a peripheral device or card, etc. Further, realizations may include fewer or additional components not illustrated in FIG. 9 (e.g., video cards, audio cards, additional network interfaces, peripheral devices, etc.). The processor 901 and the network interface 905 are coupled to the bus 903. Although illustrated as being coupled to the bus 903, the memory 907 may be coupled to the processor 901.

Figure 10A:
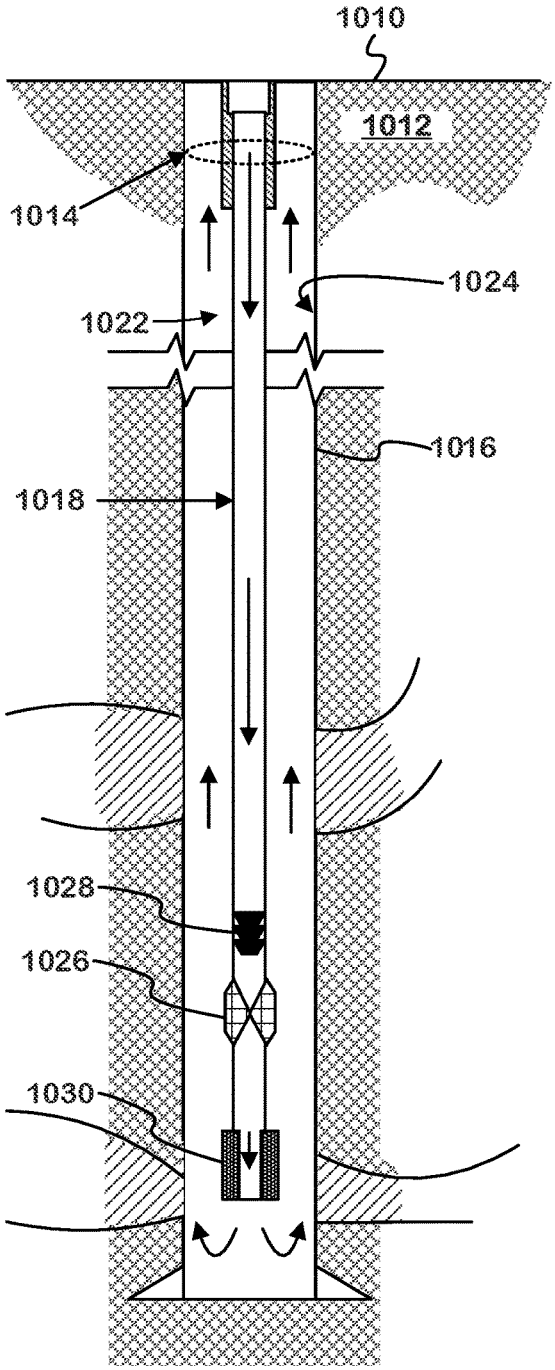
FIGS. 10A and 10B depict schematics for detecting cement progress during conventional cementing and cross-over cementing using inductance-based cement detection.
Figure 10B:
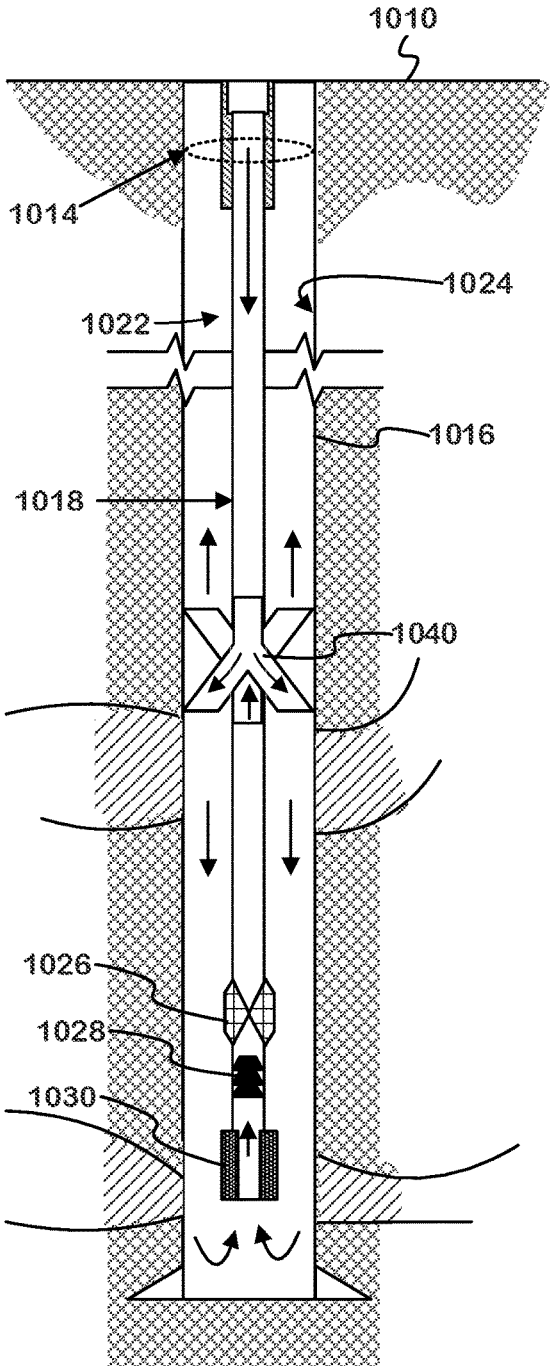

FIGS. 10A and 10B depict schematics for detecting cement progress during conventional cementing and cross-over cementing using inductance-based cement detection. FIG. 10A includes a wellbore 1014 configured for conventional cementing, in addition to other wellbore operations. A tubular 1018 is lowered into the wellbore 1014 from a surface 1010 of the formation 1012. The tubular 1018 is connected to or contains one or more sleeve 1026, one or more cementing plug 1028, and ends in one or more smart shoe 1030. The sleeve 1026 can be any sleeve and the tubular 1018 can be any tubular, as previously described.

In conventional cementing, cement or slurry is introduced from a cement or slurry source into the tubular 1018 via a slurry delivery system. The slurry source can include a dopant delivery system as well as the slurry dopant source, or the slurry delivery system can include a dopant delivery system as well as the dopant source. The slurry dopant can be any dopant as previously described.

The cement or slurry travels down the tubular 1018. The cement or slurry can be propelled through the tubular 1018 via gravity and assisted by pumping of the wellbore fluid or the displacement mud. For example, by pumping fluid through an annulus 1022 between the tubular 1018 and a wellbore wall 1016 to an exit at the surface, a closed loop system is created which advances the cement or slurry through the tubular 1018. The cement or slurry flow is detected at the smart shoe 1030, where the smart shoe 1030 operates a circuit including an inductor which detects a change in magnetic field value caused by the change in magnetic permeability between the wellbore fluid and slurry or between the wellbore fluid and a doped fluid. The smart shoe contains the wellbore fluid inductance monitor 150, as previously described.

FIG. 10B includes the wellbore 1014 configured for cross over cementing, in addition to other wellbore operations. In cross over cementing, cement or slurry is introduced from a cement or slurry source into the tubular 1018 via a slurry delivery system. The cement or slurry travels down the tubular 1018, and exits the tubular 1018 at a diverter 1040. Below the diverter 1040, the cement or slurry travels through the annulus 1022, in a method analogous to reverse cementing. The cement or slurry can be propelled through the tubular 1018 and the annulus 1022 via gravity and assisted by pumping of the wellbore fluid or the displacement mud. The cement or slurry flow is detected at the smart shoe 1030. The smart shoe contains the wellbore fluid inductance monitor 150, as previously described.

While the aspects of the disclosure are described with reference to various implementations and exploitations, it will be understood that these aspects are illustrative and that the scope of the claims is not limited to them. In general, techniques for detecting inductance changes and controlling cementing as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Terminology

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Embodiment 1: A method comprising: performing a cementing operation with a magnetically doped fluid; monitoring measures of inductance at an end of a tubular for a change to determine whether the change in the measures of inductance exceeds a sensitivity threshold; and based on a determination that the change in the measures of inductance has exceeded the sensitivity threshold, indicating detection of a front edge of the magnetically doped fluid.

Embodiment 2: The method of embodiment 1, wherein performing a cementing operation with a magnetically doped fluid comprises: magnetically doping a fluid; and delivering the magnetically doped fluid to the end of the tubular.

Embodiment 3: The method of embodiments 1 or 2, wherein the magnetically doped fluid comprises a cement slurry.

Embodiment 4: The method of any one of embodiments 1 to 3, wherein performing a cementing operation with a magnetically doped fluid further comprises controlling at least one of a magnetic permeability and a conductivity profile of the magnetically doped fluid as a function of at least one of a time, a depth, and a volume.

Embodiment 5: The method of any one of embodiments 1 to 4, wherein monitoring measures of inductance comprises: monitoring measures of at least one of a current, a voltage, a frequency, and a magnetic field strength of an electrical circuit, wherein the electrical circuit comprises an inductor.

Embodiment 6: The method of any one of embodiments 1 to 5, wherein the cementing operation comprises at least one of reverse cementing, conventional cementing, multi-stage cementing, and re-cementing.

Embodiment 7: The method of any one of embodiments 1 to 6, wherein the end of the tubular comprises a shoe having an electrical circuit comprising an inductor.

Embodiment 8: The method of any one of embodiments 1 to 7, wherein indicating detection of the front edge of the magnetically doped fluid comprises triggering a wellbore operation that impacts the cementing operation.

Embodiment 9: The method of embodiment 8, further comprising: detecting the wellbore operation at a controller of the cementing operation based, at least in part, on at least one of a pressure change and a fluid flow, wherein the wellbore operation is triggered at the end of the tubular; and adjusting a parameter of the cementing operation based on detecting the wellbore operation.

Embodiment 10: The method of embodiments 8 or 9, wherein triggering a wellbore operation comprises: terminating a fluid flow into the tubular.

Embodiment 11: The method of embodiment 10, wherein terminating a fluid flow into the tubular comprises: terminating the fluid flow into the tubular after expiration of a delay time subsequent to determination that the change exceeded the sensitivity threshold.

Embodiment 12: The method of any one of embodiments 8 to 11, wherein triggering a wellbore operation comprises triggering at least one of a valve closure, a plug delivery, a sleeve activation, and a fluid flow path diversion.

Embodiment 13: An apparatus comprising: an electrical circuit comprising at least one inductor at an end of a tubular; a processor; and a machine-readable medium having instructions stored thereon that are executable by the processor to cause the apparatus to, monitor measures of inductance of the electrical circuit for a change; determine if a change in the measures of inductance has exceeded a sensitivity threshold; and based on the determination that the change in the measures of inductance has exceeded the sensitivity threshold, trigger a wellbore operation corresponding to a cementing operation.

Embodiment 14: The apparatus of embodiment 13, wherein the electrical circuit is separated from a wall of the tubular a soft magnetic material.

Embodiment 15: The apparatus of embodiments 13 or 14, wherein the end of a tubular comprises the terminal three sections of the tubular.

Embodiment 16: The apparatus of any one of embodiments 13 to 15, wherein the measure of inductance comprises at least one of a current measurement, a voltage measurement, and a frequency measurement.

Embodiment 17: The apparatus of any one of embodiments 13 to 16, wherein the electrical circuit is integrated into a shoe.

Embodiment 18: The apparatus of any one of embodiments 13 to 17, wherein the tubular is at least one of a casing, a liner, a drill string, and coiled tubing.

Embodiment 19: An apparatus comprising: a tubular associated with a wellbore; an electrical circuit comprising at least one inductor at an end of the tubular; a processor; and a machine-readable medium having instructions stored thereon that are executable by the processor to cause the apparatus to, monitor measures of inductance of the electrical circuit for a change; determine if a change in the measures of inductance has exceeded a sensitivity threshold; and based on the determination that the change in the measures of inductance has exceeded the sensitivity threshold, trigger a wellbore operation corresponding to a cementing operation.

Embodiment 20: The apparatus of embodiment 19, wherein the electrical circuit is located at a first location of the tubular, and wherein the wellbore operation comprises terminating a fluid flow through the tubular at a second location of the tubular.

What is claimed is:

1. A method comprising:

magnetically doping a fluid based on electromagnetic characteristics of a wellbore;

performing a cementing operation with the magnetically doped fluid;

monitoring, via a wellbore fluid inductance monitor positioned on a tubular, measures of inductance at an end of the tubular for a change to determine whether the change in the measures of inductance exceeds a sensitivity threshold, wherein a soft magnetic material separates the wellbore fluid inductance monitor from the tubular; and based on a determination that the change in the measures of inductance has exceeded the sensitivity threshold, indicating detection of a front edge of the magnetically doped fluid.

2. The method of claim 1, wherein performing a cementing operation with the magnetically doped fluid comprises:

delivering the magnetically doped fluid to the end of the tubular.

3. The method of claim 1, wherein the magnetically doped fluid comprises a cement slurry.

4. The method of claim 1, wherein performing a cementing operation with a magnetically doped fluid further comprising controlling at least one of a magnetic permeability as a function of a depth.

5. The method of claim 1, wherein monitoring measures of inductance comprises:

monitoring measures of a current of an electrical circuit, wherein the electrical circuit comprises an inductor.

6. The method of claim 1, wherein the cementing operation comprises multi-stage cementing.

7. The method of claim 1, wherein the end of the tubular comprises a shoe having an electrical circuit comprising an inductor.

8. The method of claim 1, wherein indicating detection of the front edge of the magnetically doped fluid comprises triggering a wellbore operation that impacts the cementing operation.

9. The method of claim 8, further comprising:

detecting the wellbore operation at a controller of the cementing operation based, at least in part, on a pressure change, wherein the wellbore operation is triggered at the end of the tubular; and adjusting a parameter of the cementing operation based on detecting the wellbore operation.

10. The method of claim 8, wherein triggering a wellbore operation comprises:

terminating a fluid flow into the tubular.

11. The method of claim 10, wherein terminating a fluid flow into the tubular comprises:

terminating the fluid flow into the tubular after expiration of a delay time subsequent to determination that the change exceeded the sensitivity threshold.

12. The method of claim 8, wherein triggering a wellbore operation comprises triggering a valve closure.

* * * * *